United States Patent [19]

Cordle et al.

[11] 3,934,511

[45] Jan. 27, 1976

[54] LINEAR SHAPED CHARGE WARHEAD

[75] Inventors: Paul E. Cordle; Melvin J. McCubbin, both of China Lake, Calif.

[73] Assignee: The United States of America as represented by the Secretary of the Navy, Washington, D.C.

[22] Filed: Aug. 15, 1968

[21] Appl. No.: 753,038

[52] U.S. Cl. ..... 102/24 HC; 102/56 SC
[51] Int. Cl.[2] ..... F42B 3/08; F42B 1/02
[58] Field of Search ..... 102/56, 24 HC

[56] References Cited

UNITED STATES PATENTS

| | | | |
|---|---|---|---|
| 2,543,057 | 2/1951 | Porter | 102/24 HC |
| 2,605,704 | 8/1952 | Dumas | 102/24 HC |
| 2,789,504 | 4/1957 | McCloud et al. | 102/24 HC |
| 2,797,892 | 7/1957 | Ryan | 102/24 HC |
| 2,831,429 | 4/1958 | Moore | 102/24 HC |
| 2,980,018 | 4/1961 | Turechek | 102/24 HC |
| 3,165,057 | 1/1965 | Armstrong | 102/24 HC |
| 3,382,800 | 5/1968 | Biggs | 102/24 HC |

FOREIGN PATENTS OR APPLICATIONS

| | | | |
|---|---|---|---|
| 143,610 | 9/1951 | Australia | 102/24 |

*Primary Examiner*—Verlin R. Pendegrass
*Attorney, Agent, or Firm*—R. S. Sciascia; Roy Miller; Gerald F. Baker

[57] ABSTRACT

A large warhead explosive is provided with a metal liner having longitudinal corrugations. The shape of the liner causes the warhead to deliver concentrated amounts of energy to targets at some distance from the point of detonation. This energy is in the form of hypervelocity fragment beams produced by what is known as "Monroe effect" caused by the jetting of the liner as the detonation wave front progresses along the warhead.

1 Claim, 3 Drawing Figures

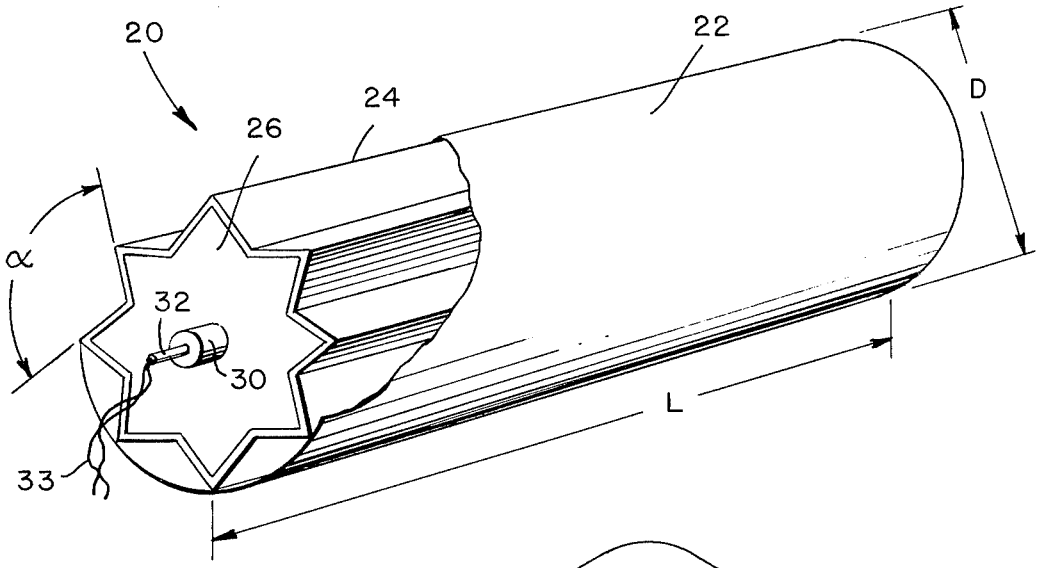
FIG. 1.
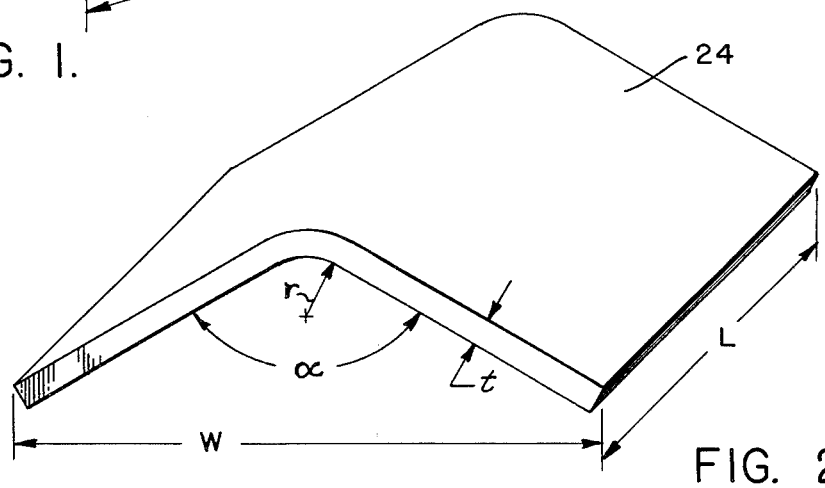
FIG. 2.
FIG. 3.
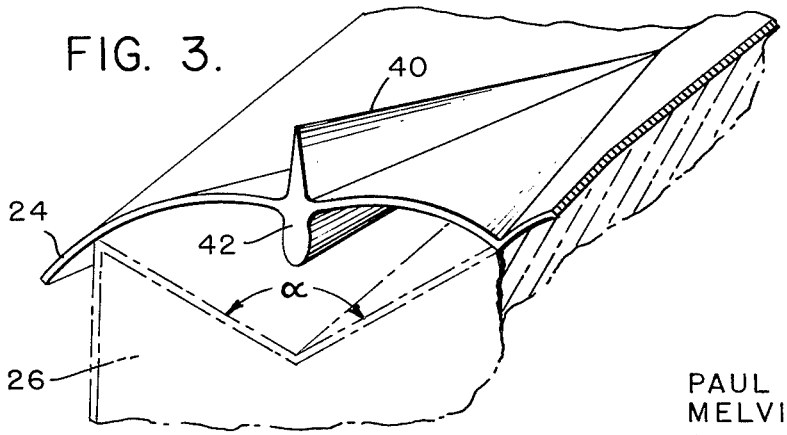
INVENTORS.
PAUL E. CORDLE
MELVIN J. MCCUBBIN
BY ROY MILLER
ATTORNEY.
GERALD F. BAKER
AGENT.

LINEAR SHAPED CHARGE WARHEAD

BACKGROUND OF THE INVENTION

This invention relates to large destructive warheads and particularly to warheads intended to destroy specific "hard" target structures. The invention particularly is related to the incorporation into such a warhead the principle of the linear shaped charge.

It is now well known that when explosive charges have the forward end hollowed out in the shape of a cone, it is possible to have much of the explosive force directed away from such end in a jet of explosive force. Recent experiments have also shown that a linear jet of explosive force can be accomplished by grooving the explosive or by providing a liner which causes the warhead to assume a grooved shape.

The present invention relates to a practical embodiment of the linear shaped charge principles to a large warhead explosive.

BRIEF DESCRIPTION OF THE DRAWING

FIG. 1 is a perspective view of a preferred embodiment of the invention with parts broken away for clarity;

FIG. 2 is a fragmentary view of the device of FIG. 1, illustrating the geometry of the liner; and FIG. 3 is a diagrammatic view illustrating the collapse of the liner.

DETAILED DESCRIPTION OF THE INVENTION

A linear shaped charge warhead according to the present invention is shown designated by the numeral 20 in FIG. 1. The warhead 20 generally comprises an outer casing 22 surrounding one or more warhead units, each comprising an explosive mixture 26 surrounded by a liner 24.

The explosive 26, which may be cyclotol, for example, is advantageously set off by a detonator 32 augmented by a booster 30. The detonator 32 may be fired in any well known manner as by electrical devices, for example, through leads 33.

Considering the geometry of the device, it is noted that each unit has a length L and a diameter D and that adjacent sides of the liner 24 form a concave angle $\alpha$. As shown in FIG. 2, the liner 24 also has a thickness t and each section has a width W. As may be noted in FIG. 2 the sides of the liner do not form an acute angle at the apex of angle $\alpha$ but preferably are formed by bending with a radius $r$ of approximately 0.4 inches.

The mechanism of liner collapse and jet formation illustrated in FIG. 3 can be compared to that of a conventional conical shaped charge. Liner collapse occurs in the same manner, in that the liner is compressed by the shock wave produced by the detonation front. Under pressure of the shock wave, the walls of the liner 24 collapse toward the center line of the angle $\alpha$, which results in the characteristic formation of a forward jet 40 and a slower moving slug 42.

It should be noted that, in order to yield best results: (1) the warhead should be end-initiated with an adequate booster system (2) the apex angle of each jet-forming liner should be about 120° for the end-initiated system (3) the charge to metal ratio (per unit length of constant geometry) should be from about 1.8 to 2.25 and (4) the length to diameter ratio should be at least three.

FIG. 3 illustrates liner collapse along a single vane of a multivaned device shortly after the initiation of the explosvie. The vane metal flows toward the center (vane vortex), and the jet element 40 begins to form above, while the slug element 42 forms below. The upward pressures cause the vane to fracture from the other portions of the liner, and this fracturing or tearing process causes the noticeable downward droop at the end of the vane wings.

With the flow of vane metal towards the center, the jet 40 and slug 42 become more massive and the vane wings shorten. The velocity gradient within the massive fragment results in vertical stretch, causing the fragment to fracture, or tear. In the final phase the velocity gradient produces longitudinal fracturing within the once single, massive fragment: the jet elements 40 fracture into a massive leading element and intermediate fragments, and the slug elements 42 fracture into a massive slug and intermediate fragments. At this stage, what remains of the vane wings also fracture from the jet and slug elements and separate into smaller fragments.

The jet leading element and slug are single, massive, rod-like fragments. The jet leading element travels at the highest velocity and the velocity of subsequent fragments progressively decreases down to the slug which travels at the lowest velocity.

The comparative effectiveness of a linear shaped charge and a blast warhead was measured for a volume limited system. In addition to the effectiveness comparison, other interesting phenomena were observed. Of particular interest were the apparent increased effects of blast produced by the linear shaped charge (for a given weight of explosive).

At a 25-foot standoff, the linear shaped charge demonstrated ability to destroy light structures such as ¼-inch steel angles, also the ability to do considerable damage against ⅜-inch steel angles.

On a 4-inch-thick witness plate, the linear shaped charge cut a line 2 inches deep and 2 inches wide across the 3-foot length. The plate was moved backward 60 feet. Damage from the blast head was limited to case fragment impacts. These impacts varied form ½ inch to 1 inch in diameter and to a maximum depth of ¾ inch.

Against two types of concrete structures, the linear jets caused severe localized damage. The damage from the blast head was equally spread over the surface of the target as it spalled 1½ inches of concrete off the face of the target.

On subsequent tests, targets were placed 10 feet from the warhead. Both types of warheads demonstrated ability to damage beyond use, steel structures with ¼-inch angles as major structural members. The linear shaped charge severely weakened steel structures using ⅜-inch angles as major structural members. The blast head did not damage the heavy steel structure sufficiently to cause ultimate failure.

In one test a 4-inch thick steel plate, 10 feet from the warhead, was severed into two pieces by a jet. Case fragments from the blast heads caused pits which varied from ½ inch to 1 inch deep when fired against steel plates 10 feet from the warhead.

From the above summations, it may be concluded that the linear shaped-charged warhead exhibits a superior capability against the targets investigated. It should also be stated, however, that such a warhead must be delivered to the targets in such a manner as to take advantage of the highly concentrated beams of fragments produced by jetting action. This advantage may be retained when the weapon is delivered at relatively small miss distances against large, hard targets.

Segmenting the warhead does not appreciably effect the jet formations, but a loss of fragment density, or total energy delivered to the target by any one jet, would necessarily accompany such a system.

The efficiency of transfer of energy into air from a detonated explosive charge has previously been considered to be 10%. This low efficiency is necessarily imposed upon a blast head because of the poorly matched acoustic impedances of the explosion and the surrounding atmosphere. If these impedances can be more closely matched, a greater efficiency of energy transfer will be realized.

Pressures recorded during this test series have indicated an increase in blast efficiency in specific areas surrounding the linear shaped-charged warhead. It is believed that this phenomena may be contributed to a "conditioning" of the atmosphere surrounding the warhead by the hypervelocity jets that supersedes the blast wave. The kinetic energy given up by the Mach 15 to 11 jets, due to aerodynamic drag, results in a heated atmosphere which is more closely matched acoustically to the emergent shock wave of the warhead.

The average intensity of peak pressure from the conventional head was 68 psi, while the pressure from the linear shaped charge varied from 52 to 72 psi.

Peak pressures from a linear shaped charge according to the invention thus indicate a substantial increase in explosive-to-air coupling, particularly in the zone adjacent to the jets. It must be remembered that, in the geometry limited approach used in these tests, the explosive weight of the conventional head was 533 lbs. of Composition B, while the explosive weight of the linear shaped charge was 377 lbs. of Composition B.

The first conclusion that one might draw from such data is that the air blast scaling laws have been defeated. However, the efficiency of transfer of shock energy from one media to the next is dependent upon the relationship of their acoustic impedances, which is the product of their densities and shock wave propagation rates. Heating the surrounding air through energy given up by aerodynamic drag will result in a higher acoustic impedance, more closely matched to that of the products of detonation. Therefore, the increased blast effects are the result of more efficient energy transfer, made possible by a prior "conditioning" of the atmosphere by the high-density, hypervelocity fragment beams. In this sense, the warhead does exceed results anticipated by the scaling laws.

What is claimed is:

1. A destructive warhead comprising;

an explosive charge of generally cylindrical formation having longitudinally extending corrugations formed in the periphery thereof;

said corrugations being defined by vanes having, side walls meeting at apices, and open mouths;

with a side wall of one groove meeting the side wall of the next adjacent groove;

the angle between the side walls relative to each apex being on the order of approximately 120°;

said explosive charge being a homogeneous mass of high order explosive material;

said charge being uniformly covered with metal to the extent that the ratio of charge to metal per unit length is in the range of about 1.8 to about 2.25; and the length to diameter ratio of the charge is at least three.

* * * * *